United States Patent [19]

Henderson

[11] Patent Number: 4,538,614

[45] Date of Patent: Sep. 3, 1985

[54] ATHLETIC GARMENT

[76] Inventor: Elizabeth Henderson, 1350 Beverly Rd., McLean, Va. 22101

[21] Appl. No.: 513,012

[22] Filed: Jul. 12, 1983

[51] Int. Cl.[3] ..... A41C 3/00

[52] U.S. Cl. ..... 128/494; 2/1; 128/427; 128/482

[58] Field of Search ..... 128/494, 427, 482, 490, 128/429, 500, 501, 504; 2/1

[56] References Cited

U.S. PATENT DOCUMENTS 1,139,448 5/1915 Smith ..... 128/482

3,628,539 12/1971 Fredricks ..... 128/427

*Primary Examiner*—Doris L. Troutman

*Attorney, Agent, or Firm*—Lalos, Leeds, Keegan

[57] ABSTRACT

The invention relates to an athletic garment for women which includes two front panels, a rear panel, shoulder straps, and connecting means for connecting the front panels together to secure the garment to the wearer. The garment includes various types of elastic material of varying elasticity and spring rates to provide the necessary support for breasts while securing the garment properly in the vertical direction to the torso of the wearer. In the vicinity of the securing means on the front of the garment, it is relatively inelastic to provide separation desired by the wearer of such a garment. The front and rear panels are of a generally planar configuration in their normal disposition and expand to the form of the person wearing the garment for support.

17 Claims, 1 Drawing Figure

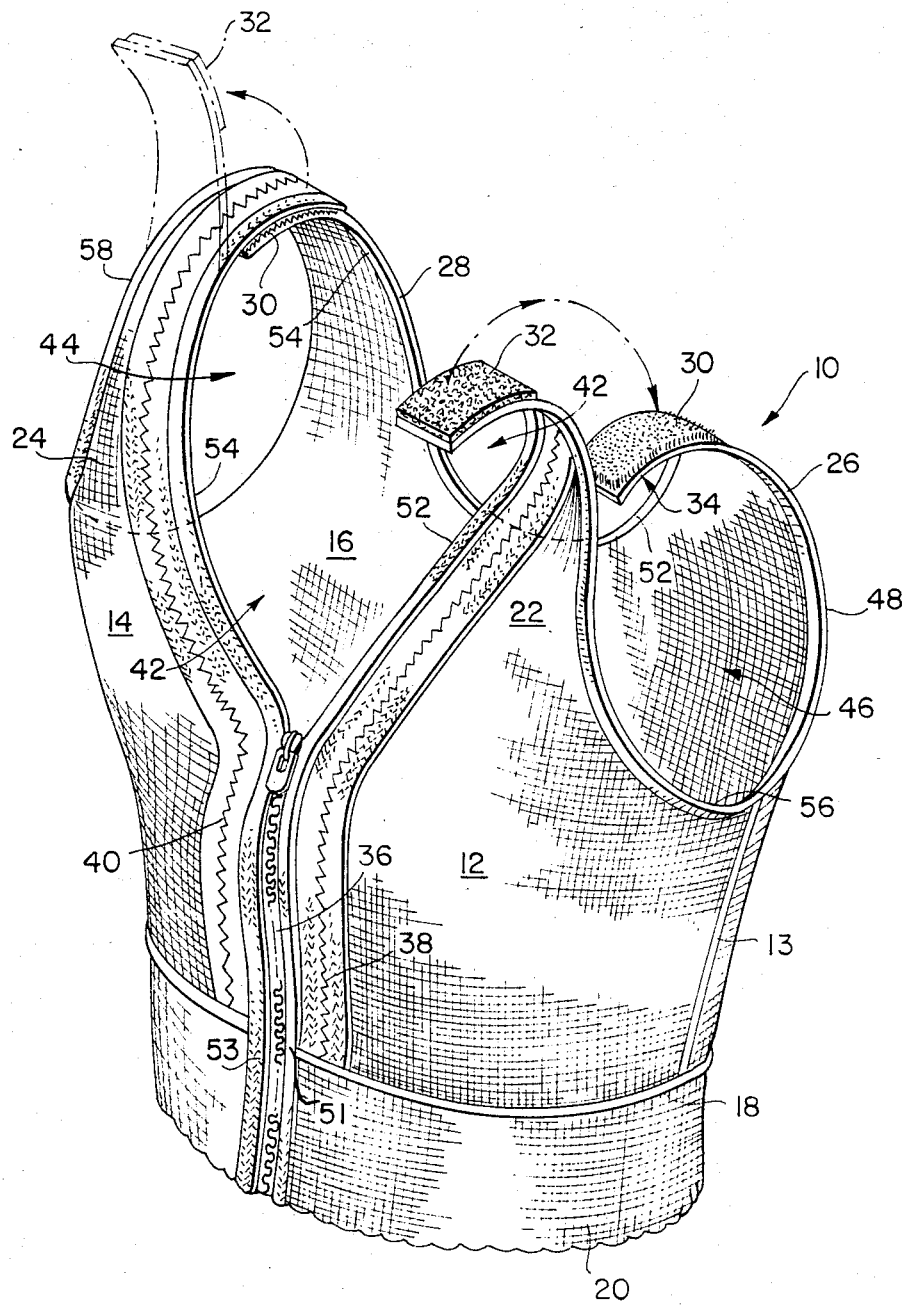
32
58
28
30
54
44
32
30
10
42
24
54
26
34
52
16
52
48
14
22
42
46
56
40
36
12
38
13
53
51
18
20

ATHLETIC GARMENT

BACKGROUND AND DISCUSSION OF THE INVENTION

Due to the growing interest in athletic activity among adults, there has been a significant growth in the clothing and other accoutrements associated with various sports such as jogging, skiing, tennis, and others. For women athletes there have been attempts to provide in the marketplace athletic brassieres suitable for women to hold the breasts comfortably and snugly to the body during a particular athletic activity. Beyond comfort and cosmetics, there are significant health reasons for requiring specially made support garments for female athletes. Without adequate support during strenuous athletic activity, such as jogging or tennis, breast tissue can actually breakdown. In addition to discomfort this can cause premature sagging of the breasts. However, garments, supposedly adapted to overcome these problems, suffered from deficiencies which have prevented their wide acceptance in the marketplace. Often they have simply been adaptations of brassieres which are used in a non-athletic environment, are expensive to manufacture, and require a multitude of sizes to fit the wearers.

There have been a number of athletic garments or sports garments for women which allegedly are adapted for athletic activity, but often do not serve the purpose for which they were made. For example, many garments are difficult to secure to the torso such that, although they may form an adequate support function, it is very difficult if not awkward to get the garment onto the torso. Others are ill-appearing and simply not suitable to wear comfortably in public. Some have used forms such as cups which require a multitude of different sizes, increase the expense by having different forms sewn or otherwise stitched in place. Deficiencies in garments without forms include inadequate separation, resulting in a reduction in the support function and an unacceptable cosmetic appearance. In addition, some garments include a number of extra straps, hooks or other securing devices which make it difficult to place a garment on a wearer and adjust the garment properly to achieve the desired support and comfort. Some garments on the other hand provide no adjustability whatsoever in which case the garment cannot be customized to the particular user.

The invention disclosed herein overcomes to a large extent all the deficiencies discussed above. Applicant has arrived at a bra which is adjustable, avoids the need for forms, is easy to place on the wearer, provides the necessary separation and can be secured adequately to the torso. The adjustability with other features reduce the number of sizes required such that one, or at least a few sizes, can fit a multitude of wearers.

To achieve the features discussed above, the garment of the invention includes at least two front panels and one rear panel made of Lycra Spandex TM or other elastic material which is generally elastic in all directions. The front panels have a connecting means to secure them together when the garment is placed on the wearer to provide an easy manner for fastening the garment in place. This configuration permits the wearer to easily see and adjust the garment to the proper position. Along the bottom edge of the garment there is an elastic band having a higher spring rate than the elastic material forming the front and rear panels. This band in addition is elastic only in the lateral direction to insure that the garment is secured properly in place vertical direction on the wearer. The straps which extend from the front panels and complementary straps from the rear panels are adjustable through adjustable fastening mechanism which in the preferred embodiment includes hook and loop fasteners such as those sold under the trademark Velcro. In this manner, the vertical position of the garment can be changed to that comfortable for the wearer very readily without any loss in the support function.

In the vicinity where the front panels of the garment are secured to one another, the garment is made substantially rigid, or has only a relatively slight elasticity in the vertical direction, to maintain the desired separation and the consequent appealing cosmetic appearance. To enhance the separation feature along with the support function, reinforcing means are included in the vicinity of the connecting means on the front panels and adjacent the edges which form the cut-out for the neck and head on the upper portions of the front panels and straps. The reinforcing means specifically include elastic strips having a width between $\frac{3}{8}$ and $\frac{7}{8}$ inches and having an elasticity less than that of the panel material, but having a spring rate greater than that of the panel material. Furthermore, the reinforcing strips are elastic only in the longitudinal direction as the strips extend vertically in the vicinity of the connecting means and along the edges forming the cut-out of the straps. With this configuration, the separation is maintained, and support along the front portion of the garment is enhanced. These features combine to insure that the garment is secured properly in the vertical direction, is fixed to the torso, and supports with the needed separation for the breasts between each of the first and second panels.

These features have simply not been accomplished by garments which presently exist in the marketplace and of which applicant is aware. For example, an athletic brassiere is disclosed in U.S. Pat. No. 4,311,150 issued to Schreiber et al. on Jan. 19, 1982. Although, there is disclosed in the Schreiber et al. patent, an athletic brassiere having a wide elastic rib-band and elastic straps, it suffers from some of the deficiencies discussed more generally above in connection with other garments. For example, there is no easy manner in which the garment can be placed on the wearer. It has be pulled over the head and the arms forced through the cut-outs for the garment to be secured in place. As a result, it is difficult to get on, assuming that sufficient spring rate and elasticity is provided in the materials. Furthermore, there is a lack of adjustability provided, requiring multitude of sizes to fit various wearers. Extra seams are apparently required to insure the needed support, and there does not appear to be in any event a provision for separation as provided in the invention disclosed herein.

The U.S. Pat. No. 4,289,137 issued to Dell et al. (hereinafter Dell) on Sept. 15, 1981, entitled "Sports Brassiere", is also directed to one-piece back, stronger underbust support, having breast cups which are made to limit upward bounce during jogging or similar athletic activities, but which have elastic panels supporting the underside of the breasts. Thus, Dell requires special forms on the bra to achieve the support function. Also the strong elastic band for securing the bra properly to the torso beneath the bust line, and the adjustability features of the invention are absent from the Dell device. Accordingly, Dell also requires a multitude of sizes to fit various users. It is not clear how the Dell garment would be secured and maintained adequately on the torso, at least in the vertical disposition, with the configuration shown and described.

Another garment which is an example of other sports garments of this type is shown in U.S. Pat. No. 4,325,378 issued to Wilkinson on April 20, 1982. This garment comprises inner and outer breast supporting flaps overfitting the liner, with the liner being independently displacable. Although some adjustability is provided in the lateral direction, there is no adjustability in the vertical direction. In addition, the garment utilizes some forms and consequently would require multitude of different sizes to fit properly for each user. And here again, as with Dell, there does not appear to be a provision for a relatively wide band of stronger elastic material to secure the garment properly in the vertical direction on the torso.

Although other garments have used fastening devices in the front of the garment and elastic bands at the base of the garment, no garment has used such devices with the adjustability and the securing means, to achieve the separation and the needed support in the vicinity of the front of the garment as applicant has in this invention. As result, the invention has been able to achieve features of support, convenience and adjustability in one garment which have not been available in the garments on the market thus far.

Although, the above has been a discussion of many advantages which characterize this invention, other advantages will become apparent from a review of the detailed discussion of the preferred embodiment which follows.

BRIEF DESCRIPTION OF THE DRAWINGS

The FIGURE is a perspective view of the garment of the invention.

DETAILED DISCUSSION OF THE PREFERRED EMBODIMENT

As can be seen from the FIGURE, garment 10 includes generally three major panels: a first front panel 12, and a second front panel 14 both secured to a rear panel 16, the latter configured to extend entirely across the back of the wearer. The front panels 12 and 14 are secured to the rear panel by vertical side seams 13 as shown. These panels are substantially continuous in surface configuration without any special forms being placed thereon. The panels are formed from Lycra Spandex TM mesh having about a hundred percent (100%) elasticity and sufficient spring forced to hold the breasts firmly in place to minimize bouncing and other movement which could detrimentally affect the tissue involved. The first and second panels 12 and 14 as well as the rear panel 16 define a continuous bottom edge 18. Attached to edge 18 is a waist band 20 also made of elastic material but being elastic only laterally or circumferentially about the waist or lower torso. In the vertical direction as shown in the FIGURE, the waist band 20 is substantially inelastic. In addition, the waist band 20 has a spring force greater than that of the elastic material used in the other panels 12, 14 and 16 described above. The width of waist band 20 is between about 1 to 2½ inches and preferably is about 2 inches. The elasticity is in the lateral direction is substantially the same, i.e., a hundred percent (100%) as the elasticity of the material used in the panels 12, 14 and 16. However, this elasticity could be somewhat less to conform to the features of the band for securing the garment in the proper vertical disposition, while allowing movement, such as expansion and contraction in the torso area.

When the two front panels 12 and 14 are secured together, a means is provided to achieve separation for the breasts supported while simultaneously maintaining the desired support needed in strenuous athletic activity. This is accomplished by using a zipper 36 in the front garment having complementary portions, one on each opposing edges 51 and 53 of panels 12 and 14 as shown. The zipper length is one which extends entirely from bottom of the elastic band 20 and terminates at the bottom of cut-out 42 for the neck and head. In this preferred embodiment zipper 36 has been slightly bunched when secured to the opposing edges of the panels 12 and 14, and consequently there is provided a slight elasticity even with the otherwise in elastic zipper. In this preferred embodiment, the elasticity provided is about seven percent (7%); but, the garment could function properly with nominal or no elasticity whatsoever in the vicinity of the zipper. The slight elasticity can aid or enhance the separation which is desired for the wearer to provide a cosmetic apppearance and a comfortable garment.

It should be understood that the separable fastener in this preferred embodiment is a zipper, but other types of fasteners could be used so long as they are generally rigid in both the vertical and the lateral directions to provide a relatively fixed object relative to the other elastic materials in the garment. Thus, any type fastener which achieves both the feature of fastening and rigidity or inelasticity can be used.

In cooperation with zipper 36 described above, a reinforced portion is provided in the vicinity of zipper 36 as well as the edge portions of the straps 22 and 24 along cut-out 42 for the neck and head. In this preferred embodiment, the reinforcing means for each panel 12 and 14 includes two strips 38 of elastic material being elastic only in the longitudinal or vertical direction when the garment is on the wearer and generally inelastic in the lateral direction. Each strip 38 is bout ⅜ inches wide, such that two strips side-by-side provide a 6/8 inches width coextensive with or spaced slightly from the opposed edges 51 and 53 of panel 12 and 14 and edges 52 and 54 defining cut-out 42. Strips 38 on each panel have a twenty percent (20%) elasticity in the longitudinal direction with no elasticity in the lateral direction. Furthermore, the spring rate of strips 38 is much higher than that of the panel material to enhance support along the strap area from the top of the shoulder to the bottom cut-out 42 and enhance separation when the garment is worn.

All of the exposed edges including edges 56 of arm cut-out 46 and edges 58 for cut-out 44 and edges 52 and 54 on front straps 24 and 22 and rear straps 26 and 28 can be of standard edging material used for garments of this type. In this case the edges are the same Lycra Spandex TM as the panel material but with elasticity only in one direction along the edge. This edging could be of a different material more or less elastic so long as it grasps securely the portions of the body extending through the cut-outs described above.

It should be noted that the straps are made adjustable in part by separable fasteners, complementary portions of which are located on each of the front and rear straps. Specifically, front strap 22 includes a loop portion of a hook and loop fastener for complementary and releasable engagement with a hook portion 30 of a hook and loop fastener secured to the rear strap 26. Similarly as shown in solid lines, the front portion of strap 24 includes another loop portion 32 to cooperate with hook portion 30 on rear strap 28. Either before or after the garment is donned, these hook and loop fasteners are engaged on front and rear straps to secure the straps in the proper position. This configuration provides adjustability for each wearer since the vertical position of the garment can be adjusted somewhat through overlapping front straps 22, 24 over the rear straps 26, 28 in securing the hook and loop fasteners together.

When donning the garment for athletic activity, the straps are secured to one another, and the garment is secured by pulling it tight about the wearer and closing zipper 36. Garment 10 is then pulled downwardly in the front to achieve and enhance the separation and to fix the garment in the appropriate and comfortable vertical position relative to the wearer. To tighten the garment along the strap area, the wearer, or someone else for that matter, can then adjust the straps by simply disengaging the fasteners by pulling one strap away from another and refastening the fastener by pressing the two straps together at a position where a comfortable fit is obtained. The hook and loop fasteners are then closed in this position and retained there until further adjustment is required.

This configuration provides a garment which can be donned quite easily and permits a few sizes to fit all wearers. The configuration permits critical adjustability, fits comfortably on every torso, and provides support while maintaining a cosmetically pleasing appearance.

I claim:

1. An athletic garment comprising:

(a) at least one front panel for covering both breasts when worn, said front panel being made of a material elastic in all directions;

(b) a rear panel connected to said front panel for extending across the back of the wearer, said rear panel being made of elastic material, elastic in all directions;

(c) said front panel and said rear panel having a bottom edge, an elastic band secured to said bottom edge and the co-extensive with said front and rear panels, said elastic band being elastic in the lateral direction, said band having an elasticity equal to or less than that of said panels for securing said garment about the torso of the wearer;

(d) said front panel having a first strap extending therefrom and a second strap extending therefrom spaced from said first strap, said straps configured to extend over the wearer's shoulders and provide a cut-out for the wearer's head and neck; and, (e) separation means for providing separation for the breasts when the garment is worn while simultaneously providing the requisite support for athletic activity, said separation means extending from the top of the elastic band to the bottom of the cut-out for the wearer's head and neck and being substantially in the center of the front panel.

2. The garment according to claim 1 wherein said separation means includes a non-elastic portion, non-elastic at least in the lateral direction.

3. The garment according to claim 2 wherein said separation means is of lesser elasticity in a direction substantially perpendicular to the lateral direction than the elasticity of the front panels.

4. The garment according to claim 3 wherein said separation means has an elasticity in a direction substantially perpendicular to the lateral direction of about between 5% and 10%.

5. The garment according to claim 3 wherein said separation means is substantially non-elastic in a direction perpendicular to the lateral direction.

6. The garment according to claim 5 wherein said means for connecting said first panel to said second panel includes a zipper.

7. The garment according to claim 6 wherein said separation means includes said zipper being secured to edge portions of said first and second panels by bunching of the zipper to achieve the lesser elasticity in the direction perpendicular to the lateral direction.

8. The garment according to claim 7 wherein said bunching is provided between the top of said band and the bottom of the cut-out for the neck and head.

9. The garment according to claim 8 wherein said separation means includes a first reinforcing means adjacent edges supporting portions of said zipper, said reinforcing means being elastic in the direction perpendicular to the lateral direction and substantially inelastic in the lateral direction, said reinforcing means being at least coextensive with said zipper.

10. The garment according to claim 9 further comprising second reinforcing means located adjacent the edges of straps defining the cut-out for the neck and head, said second reinforcing means being elastic and the direction perpendicular to the lateral direction and substantially inelastic in the lateral direction.

11. The garment according to claim 10 wherein said band has a greater spring rate than said panels in the lateral direction to secure the garment to the torso when worn.

12. The garment according to claim 11 wherein said first and second reinforcing means includes elastic strips coextensive with said zipper and the edges of said straps, said strips having a width of about $\frac{7}{8}$ of an inch.

13. The garment according to claim 1 comprising rear straps extending from said rear panel and being separate from said front straps.

14. The garment according to claim 13 further comprising adjustable connecting means for connecting said rear straps to said front straps when the garment is worn.

15. The garment according to claim 14 wherein said connecting means includes separable fasteners.

16. The garment according to claim 15 wherein said fasteners are of the hook and loop type and one strap contains one portion of hooks and the other strap contains. on an opposing face, a complementary portion of loops for interengagement with the hooks.

17. The garment according to claim 9 wherein at least one edge supporting said zipper has a protective means to protect the wearer from the zipper when the garment is worn.

* * * * *